US006948637B1

(12) United States Patent
Jacobs

(10) Patent No.: US 6,948,637 B1
(45) Date of Patent: Sep. 27, 2005

(54) APPARATUS FOR DISCHARGING PRESSURIZED LIQUIDS AT ELEVATED POSITIONS

(76) Inventor: Todd Jacobs, 508 Pleasant Hill Rd., Frankfort, IL (US) 60423

( * ) Notice: Subject to any disclaimer, the term of this patent is extended or adjusted under 35 U.S.C. 154(b) by 0 days.

(21) Appl. No.: 10/873,513

(22) Filed: Jun. 23, 2004

(51) Int. Cl.[7] ..... B67D 5/64
(52) U.S. Cl. ..... 222/174; 222/402.1; 248/310
(58) Field of Search ..... 222/174, 402.1, 222/522, 523, 525; 248/310, 311.2

(56) References Cited

U.S. PATENT DOCUMENTS 3,013,699 A * 12/1961 Meuwly ..... 222/174
3,017,056 A * 1/1962 Bishop ..... 222/164
3,039,657 A * 6/1962 Meuwly ..... 222/174
3,220,613 A * 11/1965 Palmer et al. ..... 222/174
3,473,700 A * 10/1969 Batistelli ..... 222/174
3,794,217 A * 2/1974 Munchel ..... 222/174
3,964,647 A * 6/1976 Dearling ..... 222/174
6,663,307 B2 * 12/2003 Kopanic et al. ..... 401/190

* cited by examiner

*Primary Examiner*—David A. Scherbel
*Assistant Examiner*—Patrick Buechner
(74) *Attorney, Agent, or Firm*—Davis Chin

(57) ABSTRACT

An apparatus for discharging pressurized liquids at elevated positions includes a holding adapter, an actuating assembly, and an extension pole. The holding adapter includes first body member for holding a canister of pressurized liquid. The canister has an actuating stem extending from its top end thereof. An actuator nozzle is formed of an annular flange and a cap-like head portion. The head portion is disposed over the actuating stem. A handle portion is formed integrally with the first body member and extending downwardly from the holding adapter. The actuating assembly is telescoped over the canister and the holding adapter and includes a second body member for applying a downward force on the annular flange of the actuating nozzle to activate the actuating for discharging the pressurized liquid therefrom. The extension pole is operatively connected to a distal end of the handle portion and is adjustable to desired elevated positions.

20 Claims, 4 Drawing Sheets

APPARATUS FOR DISCHARGING PRESSURIZED LIQUIDS AT ELEVATED POSITIONS

BACKGROUND OF THE INVENTION

This invention relates generally to apparatuses for discharging pressurized liquids and more particularly, the present invention relates to an improved apparatus for discharging pressurized liquids at elevated positions in an effective and efficient manner.

As is generally well-known, pressurized containers or canisters housing various types of fluids, such as liquid insect sprays for killing wasps, bees, hornets and the like, are widely used in everyday life. Conventionally, these pressurized canisters include a cylindrically-shaped body of a predetermined length and an actuating stem disposed at a top end thereof. An actuating member or button is typically connected to the actuating stem which is manually operated by the index finger of a user or consumer. When the actuating member is depressed, the liquid contents of the pressurized canister is discharged or released therefrom in the form of a spray, i.e., liquid insect spray.

However, these prior art pressurized canisters used for killing wasps, bees, hornets and the like suffer from the disadvantage of being capable of applying a spray only for a relatively short distance, such as twenty feet or less. Thus, these prior art pressurized containers must be held fairly close to the insect's nest by the user in order to be effective. Frequently, the insect's nest will be located at remote or elevated positions which are difficult to reach, such as in the gutters of houses or up in a tree. In these situations, the users are forced to resort to Neanderthal extermination methods, such as placing a ladder on the side of the house or tree and climbing up the same, while at the same time holding on to the pressurized canister and depressing the button with one hand. These methods are ineffective and inefficient and many a times can jeopardize the personal safety of the user.

Furthermore, during certain weather conditions such as on a windy day, the spray from the pressurized canister for the relatively short distance will probably not even reach the nest and will thus be totally ineffective. In addition, the spray being in the form of an insecticide may be toxic and harmful if it comes into contact with the user.

Accordingly, it would be desirable to provide an improved apparatus for discharging or dispensing the contents of a pressurized canister at or on desired elevated locations in an effective and efficient manner. It would be expedient that the apparatus for discharging the pressurized contents be relatively simple and inexpensive in design, construction, and operation. It would also be expedient that the apparatus for discharging the pressurized contents at the elevated locations be capable of being operable safely without the need of climbing a ladder and the like.

SUMMARY OF THE INVENTION

Accordingly, it is a general object of the present invention to provide an improved apparatus for discharging pressurized liquids at elevated positions which is relatively simple and inexpensive in design, construction and operation.

It is an object of the present invention to provide an improved apparatus for discharging pressurized liquids at elevated positions on an effective and efficient manner.

It is another object of the present invention to provide an improved apparatus for discharging pressurized liquids at elevated positions which can be operated safely without the need of climbing a ladder and the like.

It is still another object of the present invention to provide an improved apparatus for discharging pressurized liquids at elevated positions which includes a holding adapter for holding a container of pressurized fluid, an actuating assembly telescoped over the container and the holding adapter, and an adjustable extension pole connected to the holding adapter.

In a preferred embodiment of the present invention, there is provided an apparatus for discharging pressurized liquids at elevated positions which includes a holding adapter, an actuating assembly, and an extension pole. The holding adapter includes a first body member having a closed bottom base and a cylindrical side wall extending upwardly from the closed bottom base and terminating in an open top end. The first body member is adapted to hold a canister of pressurized liquid. The canister has an actuating stem extending from its top end thereof. An actuator nozzle is formed of an annular flange and a cap-like head portion. The head portion is disposed over the actuating stem. A handle portion is formed integrally with and extending downwardly from the closed bottom base of the first body member of the holding adapter.

The actuating assembly is telescoped over the canister and the holding adapter and includes a second body member having a closed top end and a cylindrical side wall extending downwardly from the closed top end and terminating in an open bottom end. The closed top end of the second body member is formed with a central aperture for receiving therethrough the head portion of the actuator nozzle when the actuating assembly is telescoped over the canister and the holding adapter. The second body member of the actuating assembly applies a downward force on the annular flange of the actuating nozzle so as to cause the actuating stem to be activated for discharging the pressurized liquid therefrom. The extension pole is operatively connected to a distal end of the handle portion and is adjustable so as to accommodate desired elevated positions.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
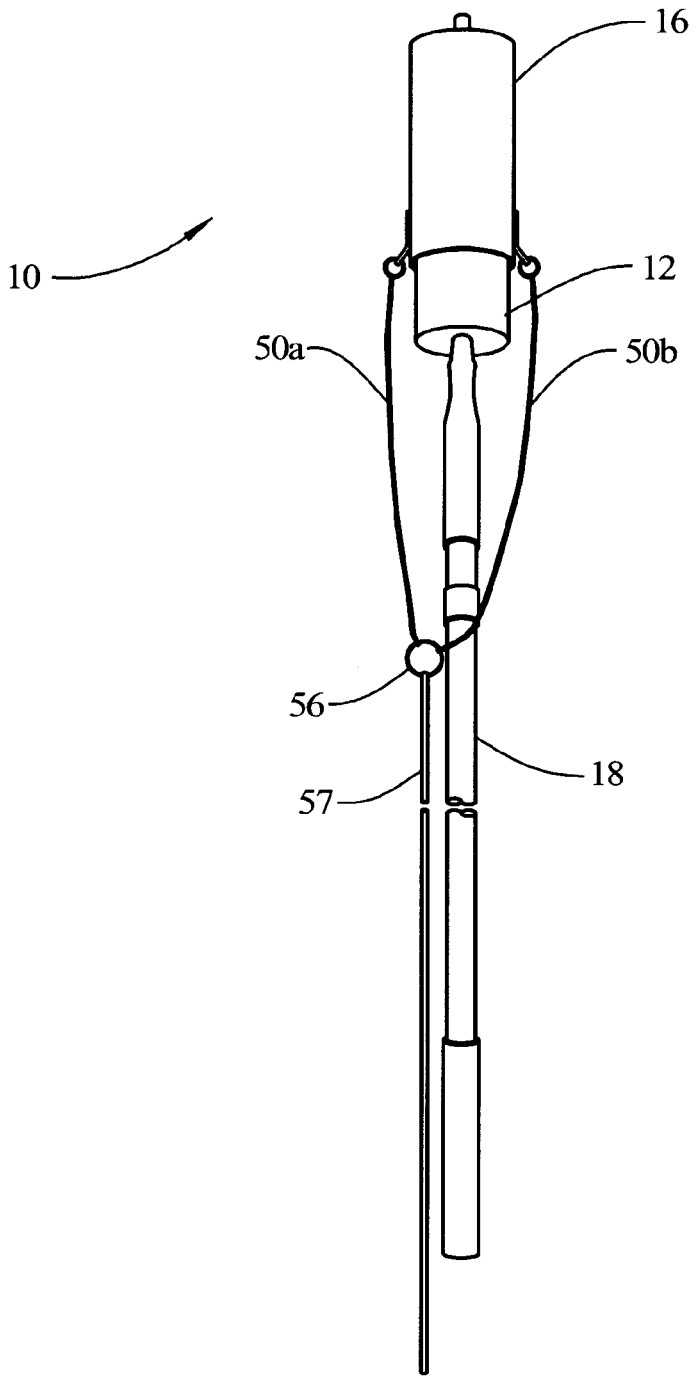
FIG. 1 is a front plan view of an apparatus for discharging pressurized liquids at elevated positions, constructed in accordance with the principles of the present invention and illustrated in its fully assembled condition.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Figure 2:
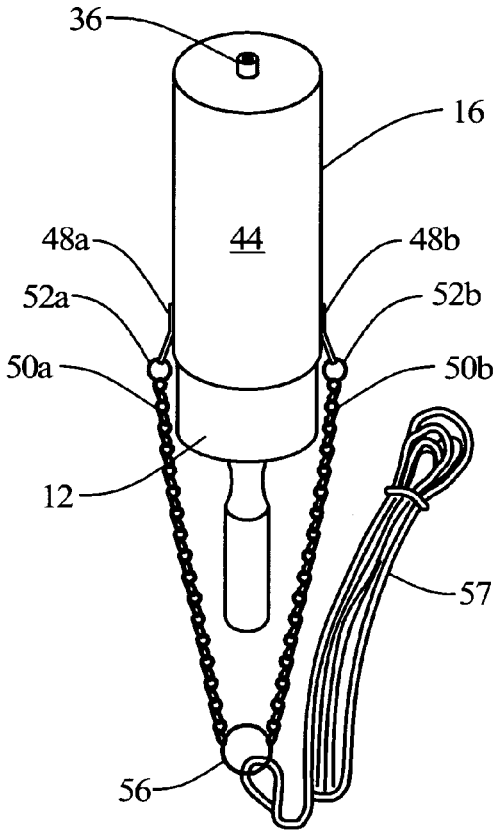
FIG. 2 is a view similar to FIG. 1, but with the adjustable extension pole being removed.
Figure 3:
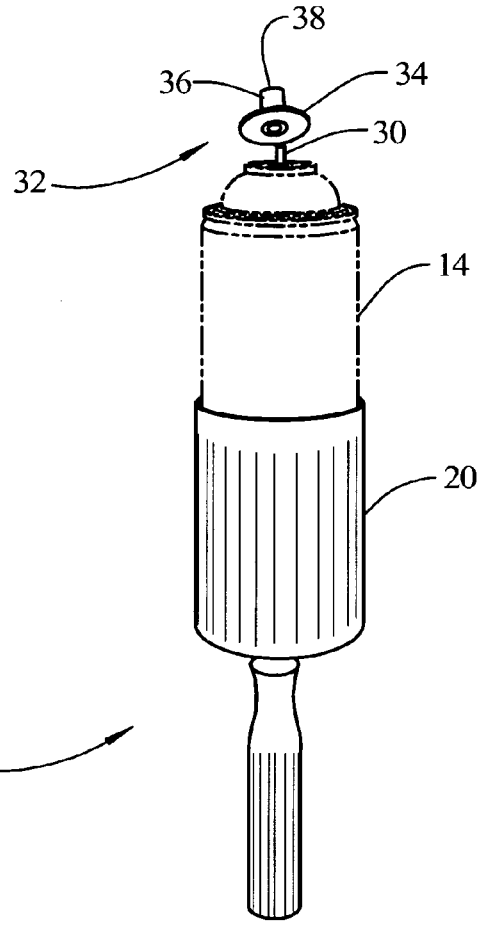
FIG. 3 is a plan view of the holding adapter, similar to FIG. 2, but with the actuating assembly being removed.
Figure 4:
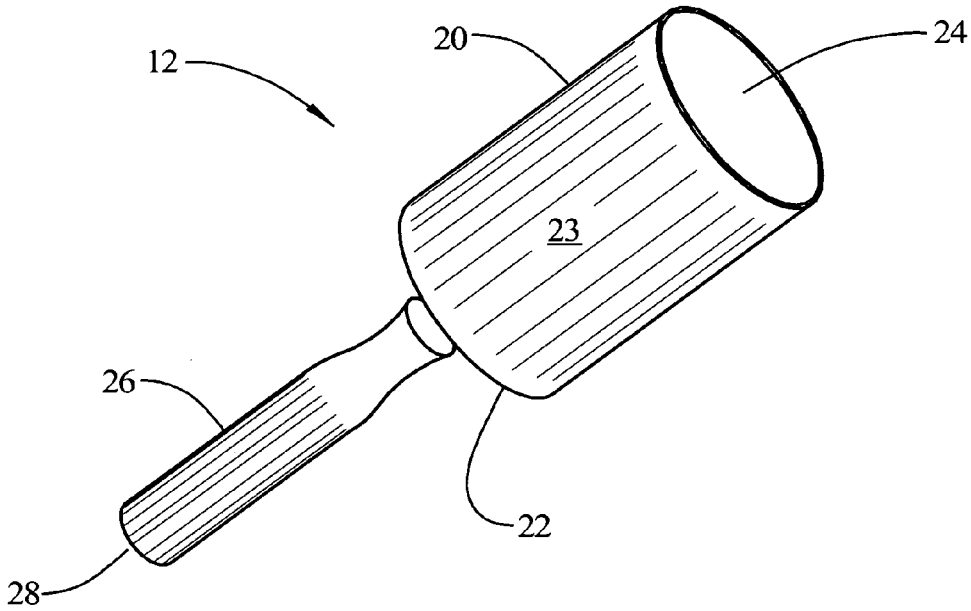
FIG. 4 is a perspective view of the holding adapter of FIG. 3, but with the pressurized canister being removed.
Figure 5:
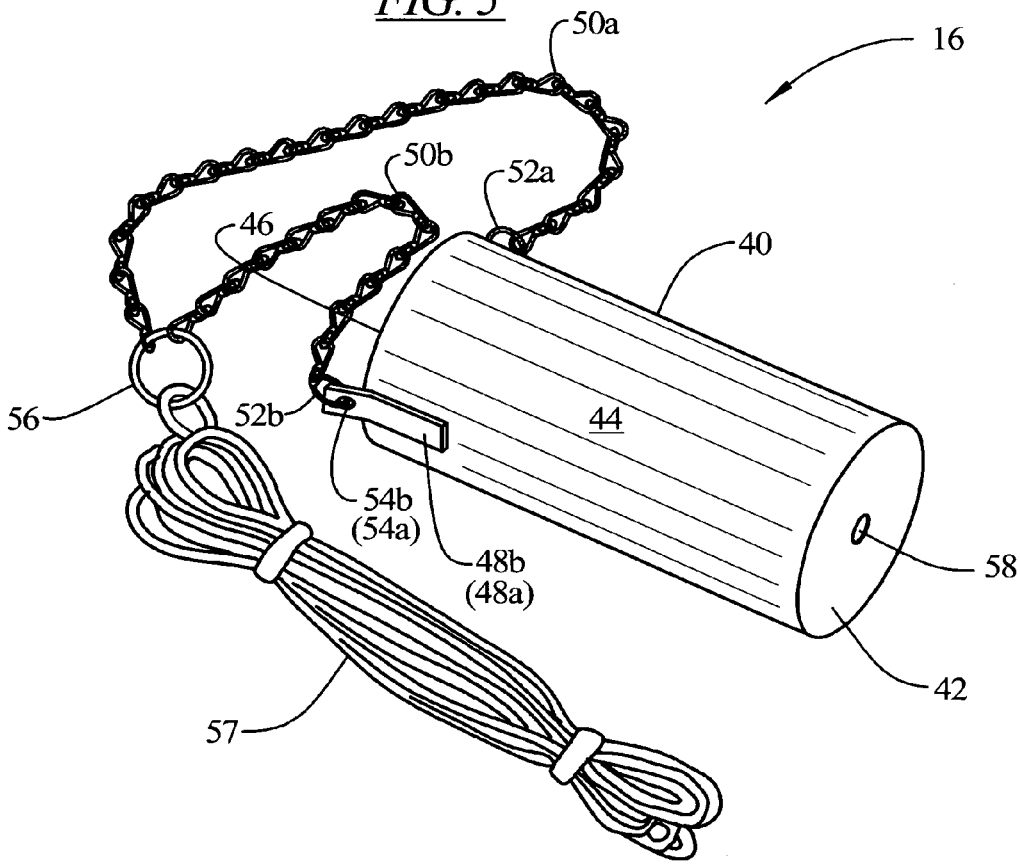
FIG. 5 is a perspective view of the actuating assembly of FIG. 1.

Referring now in detail to the drawings, there is illustrated in FIG. 1 an improved apparatus 10 for discharging pressurized liquids at elevated positions, constructed in accordance with the principles of the present invention and depicted in its fully assembled condition. FIG. 2 is a plan view of the apparatus 10, similar to that of FIG. 1, except that the adjustable extension pole 18 has been removed. FIG. 3 is a plan view of the holding adapter 12 of the present invention of FIG. 1. FIG. 4 is a perspective view of the holding adapter 12, similar to FIG. 3, but with the pressurized canister 14 being removed. FIG. 5 is a prospective view of the actuating assembly 16 of FIG. 1.

As can be seen from FIGS. 1 through 5, the improved apparatus 10 for discharging pressurized liquids at elevated positions includes a holding adapter 12, a canister or container 14 of a pressurized active ingredient disposed in the holding adapter 12, an actuating assembly 16 telescoped over the canister 14 and the holding adapter 12, and an adjustable extension pole 18 connected to the holding adapter 12. The holding adapter 12 includes a body member 20 which has a generally cylindrical shape and is dimensioned and contoured so as to receive the conventionally sized pressurized canister 14. However, it should be understood that the holding adapter 12 may have various other cross-sectional configurations, such as square, rectangle, oval, and the like so as to accommodate different shaped canisters. The body member 20 is formed by a circular planar closed bottom base 22 and a circumferential side wall 23 which extends upwardly from the bottom base 22 and terminates in an open top end 24.

In the preferred embodiment, the body member 20 has preferably a height dimension of approximately five inches and a diameter dimension of about three inches. A hollow handle portion 26 is formed integrally with and extends downwardly from the bottom base 22 of the body member 20. The distal end 28 of the handle portion 26 is provided internal threads for mating with the external threads formed on the top end of the extension pole 18. The handle portion has preferably a length dimension of about five inches and a diameter dimension of about one inch.

It should be noted that the shape and the dimensions for the holding adapter 12 are supplied for illustrative purposes and may be varied considerably provided that the essential features, function, and attributes of the present invention described herein are not sacrificed. The holding adapter 12 may be formed of any suitable lightweight material, such as thin gauge metal, fiberglass, wood, high strength plastic and the like as desired by a user. Preferably, the holding adapter is generally molded of a one-piece construction of plastic material having a thickness of about three-sixteenth of an inch so as to provide sufficient strength and durability.

The conventional pressurized canister 14 has a cylindrical configuration and includes an actuating stem 30 formed in the center of its top end. The canister contains a source of varied pressurized fluids, such as a liquid insect spray for killing wasps, bees, hornets, and the like. Alternatively, the pressurized fluid disposed in the canister may be spray paint for painting, a tree tar sealant for protecting freshly cut tree limbs, or active ingredients for performing a particular task.

Figure 6:
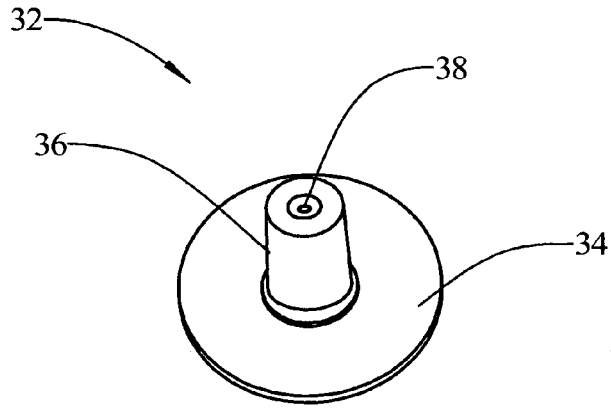
FIG. 6 is an enlarged, front plan view of the actuator nozzle of the present invention in FIG. 3.

Referring again to FIG. 3, there is illustrated an actuating nozzle 32 of the present invention operatively connected for use with the actuating stem 30 of the canister. As can best be seen from FIG. 6, the actuating nozzle 32 is comprised of an annular flange 34 and a cap-like head portion 36 formed integrally in the center of the annular flange 34 and extending vertically therefrom. The actuating nozzle is press fitted over the canister stem 30 so the stem extends through an opening 38 in the head portion. The nozzle is preferably made of a plastic material which is fabricated by injection molding.

In FIG. 5, the actuating assembly 16 includes a body member 40 which has a generally cylindrical shape and is dimensioned and contoured so as to be telescoped over the canister 14 and the holding adapter 12. The body member 40 is formed with a circular planar closed top lid end 42 and a circumferential side wall 44 which extends downwardly from the top lid end 42 and terminates in an open bottom end 46. The body member has preferably a length dimension of about seven inches and a diameter dimension of slightly over three inches.

The actuating assembly 16 further includes a pair of outwardly flared tab members 48*a*, 48*b* which are fixedly secured to and disposed diametrically opposite each other on the outer surface of the side wall 44 adjacent to the open bottom end 46. A first linked chain 50*a* has its one end connected to the tab member 48*a* via a small ring 52*a*. The small ring 52*a* is connected to the one end of the chain 50*a* and is also joined to an opening 54*a* formed in the distal end of the tab member 48*a*. Similarly, a second linked chain 50*b* has its one end connected to the tab member 48*b* via a small ring 52*b*. The small ring 52*b* is connected to the one end of the chain 50*b* and is also joined to an opening 54*b* formed in the distal end of the tab member 48*b*. The other ends of the small rings 52*a*, 52*b* are joined together by a larger ring 56. A rope 57 is also tied to the larger ring 56 which permits a user to pull the chains 50*a*, 50*b* in unison. The closed top lid end 42 of the body member 40 is formed with a central aperture 58 which is sized so as to allow the head portion 36 of the actuating nozzle 32 to pass cleanly therethrough.

In the preferred embodiment, each of the chains 50*a*, 50*b* has a length dimension of about one foot and the rope 57 has a length dimension of about fifteen feet. The two small rings 52*a*, 52*b* are about one-half inch in diameter. The larger ring 56 is about one inch in diameter.

In assembly, the conventional actuating nozzle of a pressurized canister is initially removed and the actuating nozzle 32 of the present invention is installed on the actuating stem 30 of the canister. Then, the bottom end of the pressurized canister 14 is inserted into the open top end 24 of the body member 20 of the holding adapter 12, as is illustrated in FIG. 3. Next, the body member 40 of the actuating assembly 16 is telescoped over the canister 14 and the holding adapter 12 with the head portion 36 of the actuating nozzle 32 extending through the aperture 58 in the top end thereof. This is illustrated in FIG. 2 of the drawings. Finally, the top end of the extension pole 18 having the external threads are threaded into the internal threads in the handle portion 26 of the holding adapter 12 so as to provide the fully assembled apparatus 10, as depicted in FIG. 1.

In use, the user will initially adjust the extension pole 18 to the proper length so as to reach the elevation level of the insect's nest to be sprayed. Preferably, the apparatus 10 is positioned to be approximately five feet to nine feet from the nest. After the extension pole length has been adjusted to the desired length, the user will then hold and raise the apparatus into position with one hand and apply a pulling motion or downward force on the rope 57 with the other hand. This pulling action on the rope will cause the body member 40 of the actuating assembly 16, to move downward due to the force being transferred by the chains 50*a*, 50*b* and the tab members 48*a*, 48*b*. As a result, the top surface of the annular flange 34 of the nozzle 32 will be forced downward by the closed top end 42 of the body member of the actuating assembly. This will in turn cause the stem 30 of the canister 14 to be activated for releasing or dispensing of the fluid from the canister.

Figure 7:
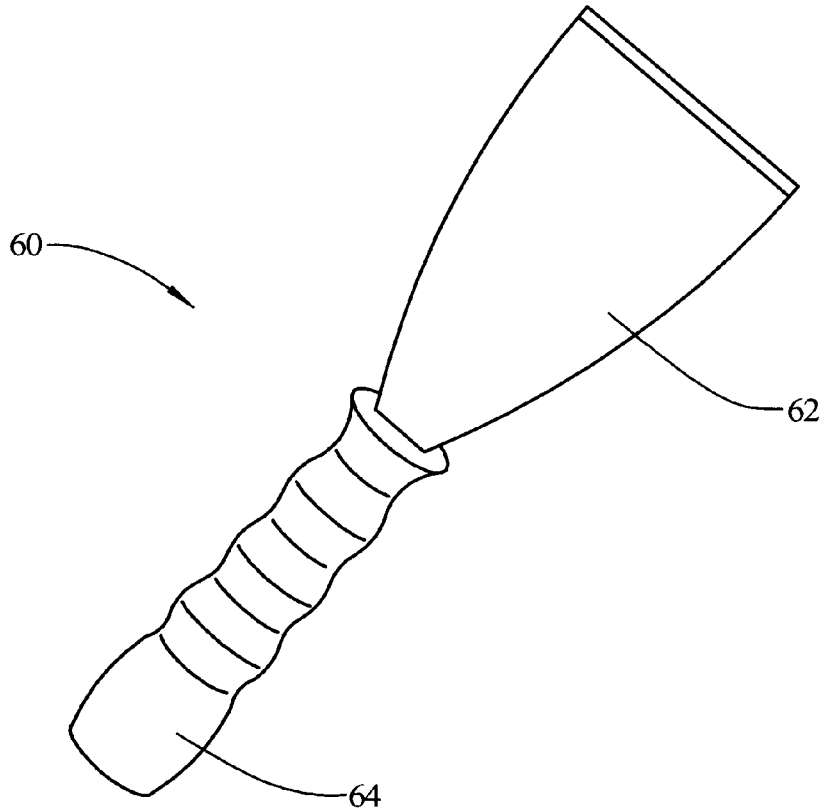
FIG. 7 is a plan view of a scraper attachment for use with the adjustable extension pole of FIG. 1.

After the spraying is finished, the user can lower the apparatus and then proceed to performing other desired projects. Alternatively, the apparatus can be disassembled by performing in reverse order the above-described assembly instructions. Further, a scraper attachment 60 can now be threaded onto the extension pole 18 for use in knocking down the sprayed insect's nest after the extermination has been completed. As shown in FIG. 7, the scraper attachment 60 is comprised of a tapered scraper blade 62 and a hollow handle portion 64 joined integrally to the narrow end of the blade 62. The handle portion 64 is provided with internal threads for mating with the external threads on the top end of the extension pole 18. The extension pole may be formed of any suitable lightweight material, such as thin gauge metal, fiberglass, high strength plastic and the like.

From the foregoing detailed description, it can thus be seen that the present invention provides an improved apparatus for discharging pressured liquids which includes a holding adapter for holding a canister of pressurized active ingredient, an actuating assembly disposed over the canister and the holding adapter, and an adjustable extension pole connected the holding adapter. As a result, the apparatus can be used at desired elevated locations in a safe manner without the need of climbing a ladder and the like.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An apparatus for discharging pressurized liquids at elevated positions, comprising:

a holding adapter including a first body member having a closed bottom base and a cylindrical side wall extending upwardly from said closed bottom base and terminating in an open top end;

said first body member being adapted to hold a canister of pressurized liquid, said canister having an actuating stem extending from its top end thereof;

an actuator nozzle formed of an annular flange and a cap-like head portion, said head portion being disposed over said actuating stem;

a handle portion being formed integrally with and extending downwardly from said closed bottom base of said first body member of said holding adapter;

an actuating assembly being telescoped over said canister and said holding adapter and including a second body member having a closed top end and a cylindrical side wall extending downwardly from said closed top end and terminating in an open bottom end;

said closed top end of said second body member being formed with a central aperture for receiving therethrough said head portion of said actuator nozzle when said actuating assembly is telescoped over said canister and said holding adapter;

said actuating assembly including actuating means operatively connected to said second body member for applying a downward force on said closed top end thereof and said annular flange of said actuating nozzle so as to cause said actuating stem to be activated for discharging the pressurized liquid therefrom; and an extension pole being operatively connected to a distal end of said handle portion and being adjustable so as to accommodate desired elevated positions.

2. An apparatus for discharging pressurized liquids as claimed in claim 1, wherein said holding adapter is molded of a one-piece construction of plastic material.

3. An apparatus for discharging pressurized liquids as claimed in claim 1, wherein said holding adapter is formed of a lightweight material.

4. An apparatus for discharging pressurized liquids as claimed in claim 3, wherein said lightweight material is formed of a thin gauge metal.

5. An apparatus for discharging pressurized liquids as claimed in claim 3, wherein said lightweight material is formed of a high strength plastic.

6. An apparatus for discharging pressurized liquids as claimed in claim 1, wherein said actuator nozzle is made of a plastic material.

7. An apparatus for discharging pressurized liquids as claimed in claim 1, wherein said extension pole is formed of a lightweight material.

8. An apparatus for discharging pressurized liquids as claimed in claim 7, wherein said lightweight material is formed of a thin gauge metal.

9. An apparatus for discharging pressurized liquids as claimed in claim 7, wherein said lightweight material is formed of a high strength plastic.

10. An apparatus for discharging pressurized liquids as claimed in claim 1, wherein said actuating means includes a pair of tab members disposed opposite each other on the side wall of said second body member, chains operatively connected to said pair of tab members, and a rope coupled to said chains, thereby allowing a user to pull down on said actuating assembly.

11. An apparatus for discharging pressurized liquids at elevated positions, comprising:

holding adapter means for holding a canister of pressurized liquid, said canister having an actuating stem extending from its top end thereof;

actuating nozzle means being disposed over said actuating stem;

said handle means being formed integrally with said holding adapter means for connection to extension pole means;

actuating means being telescoped over said holding adapter means for applying a downward force on said actuator nozzle means to cause said actuating stem to be activated for discharging the pressurized liquid therefrom; and said extension pole means being operatively connected to said handle means for varying the length thereof so as to accommodate desired elevated positions.

12. An apparatus for discharging pressurized liquids as claimed in claim 11, wherein said holding adapter means is molded of a one-piece construction of plastic material.

13. An apparatus for discharging pressurized liquids as claimed in claim 11, wherein said holding adapter means is formed of a lightweight material.

14. An apparatus for discharging pressurized liquids as claimed in claim 13, wherein said lightweight material is formed of a thin gauge metal.

15. An apparatus for discharging pressurized liquids as claimed in claim 13, wherein said lightweight material is formed of a high strength plastic.

16. An apparatus for discharging pressurized liquids as claimed in claim 11, wherein said actuator nozzle means is made of a plastic material.

17. An apparatus for discharging pressurized liquids as claimed in claim 11, wherein said extension pole is formed of a lightweight material.

18. An apparatus for discharging pressurized liquids as claimed in claim 17, wherein said lightweight material is formed of a thin gauge metal.

19. An apparatus for discharging pressurized liquids as claimed in claim 17, wherein said lightweight material is formed of a high strength plastic.

20. An apparatus for discharging pressurized liquids as claimed in claim 11, wherein said pressurized liquid is comprised of an insect spray.

* * * * *